US006865989B2

(12) United States Patent
Kölbli

(10) Patent No.: US 6,865,989 B2
(45) Date of Patent: Mar. 15, 2005

(54) ELECTRONIC SELF-DESTRUCT DEVICE

(75) Inventor: Bertram Kölbli, Frankfurt (DE)

(73) Assignee: Honeywell AG, Offenbach Am Main (DE)

( * ) Notice: Subject to any disclaimer, the term of this patent is extended or adjusted under 35 U.S.C. 154(b) by 0 days.

(21) Appl. No.: 10/258,235

(22) PCT Filed: Mar. 22, 2001

(86) PCT No.: PCT/EP01/03263

§ 371 (c)(1),
(2), (4) Date: Oct. 22, 2002

(87) PCT Pub. No.: WO01/81855

PCT Pub. Date: Nov. 1, 2001

(65) Prior Publication Data

US 2003/0136290 A1 Jul. 24, 2003

(30) Foreign Application Priority Data

Apr. 22, 2000 (DE) ..... 100 20 037

(51) Int. Cl.[7] ..... F42C 11/02
(52) U.S. Cl. ..... 102/210; 102/231
(58) Field of Search ..... 102/210, 231

(56) References Cited

U.S. PATENT DOCUMENTS 3,808,975 A * 5/1974 Stutzle et al. ..... 102/70.2
4,240,350 A * 12/1980 Munzel et al. ..... 102/215
4,712,477 A 12/1987 Aikou et al. ..... 102/206
5,269,223 A 12/1993 Mattsson et al. ..... 102/210
5,942,714 A 8/1999 Oberlin et al. ..... 102/210

FOREIGN PATENT DOCUMENTS

| | | |
|---|---|---|
| DE | 23 14 273 | 5/1981 |
| DE | 43 24 486 | 1/1995 |
| DE | 38 00 328 | 1/1996 |
| DE | 195 04 870 | 1/1997 |
| EP | 0 369 665 | 5/1990 |

* cited by examiner

*Primary Examiner*—Jack Keith
(74) *Attorney, Agent, or Firm*—Wenderoth, Lind & Ponack, L.L.P.

(57) ABSTRACT

A device provides for time-controlled self-destruction of a projectile by a batteryless, electronic self-destruct device. Several capacitors charged by a piezo element or a surge generator during firing are used in the flight phase for operational purposes. At least two of the capacitors are connected to the input of a comparator, so that the influence of a constantly modifiable operational voltage and the influence of a discharge of modifiable voltage levels by the piezo element or surge generator does not affect the time function.

5 Claims, 1 Drawing Sheet

ELECTRONIC SELF-DESTRUCT DEVICE

BACKGROUND OF THE INVENTION

1. Field of the Invention

The present invention relates to a configuration for an electronic self-destruct device in a projectile detonator without the use of a battery installed in the detonator.

2. Description of the Related Art

Apart from the main detonation criteria, such as impact or time function, for today's projectile or submunition detonators frequently a self-destruction function is also demanded, which also ignites the explosive in the absence of a response of the primary ignition criteria after the passage of a maximum function time. This function, parallel to the other ignition criteria, is intended to limit the danger range of the munition in the firing direction and/or minimize the occurrence of dud shots. This makes utilization in previously conquered territories safer due to the lower danger through one's own duds. This function also permits, on the other hand, the bombardment of an encircled enemy without endangering opposing troops of one's own or civilian installations beyond a justifiable degree.

SUMMARY OF THE INVENTION

Mechanical, pyrotechnical and electronic self-destruct devices are known in different implementations. The present object is based on the required operation of an electronic self-destruct device without using a battery. This has the advantage that the self-destruct function of detonators thus equipped is retained highly reliably even over a long storage time of the detonator, since the reliability of detonator functions is essentially a function of the reliability of the energy supply. The reliability of the self-destruct function, however, over tactical deployment is not only critical to function, but also to safety. For that reason, all structural elements impairing the functional reliability should be eliminated as much as possible.

Building on this prior art, the present invention therefore has as its object specifying a new configuration with the self-destruct function, specifically of projectile detonators, which operates without a battery.

Utilizing for the electric operation of the self-destruct device the electric energy of one or several piezo elements is known. During the firing process, due to the high acceleration occurring, the piezo element outputs for a time period of a few milliseconds a high voltage which for longer-duration operation of a current-saving electronic circuitry is transferred with changed voltage level into storage capacitors.

The problem of such an energy supply lies in the case of utilization of the electronic circuitry for the realization of a highly precise time function. Although the supply voltage change is of extreme magnitude, the energy supply capacitors are only charged through the firing, and subsequently are continuously discharged through the current to be supplied by the capacitors. For reasons of cost and reliability, the time function is to be realized with RC networks instead of by mechanical oscillators, such as a quartz [oscillator] or a resonator, which can be damaged during the firing. However, the oscillation frequency of RC oscillators is highly dependent on the operating voltage such that application for a self-destruction, in general, is not possible.

It would be possible to stabilize the output voltage of an energy storage capacitor with the aid of a switching regulator in order to provide for the electronic circuitry a voltage as constant as feasible. However, this has the disadvantage of a relatively large circuit expenditure connected with energy losses through the voltage changer.

A second solution would be to employ the output voltage of the piezo elements for the realization of the time function, to charge a capacitor C to a voltage $U_o$ and to discharge the capacitor C via a resistance R, in order to detect with the aid of a comparator if a voltage level $U_S$ falls below a specific level which occurs after time $$t_S = -R\,C\,\ln(U_S/U_o) \tag{1}$$

After this time, the comparator output changes its state. This change is employed for igniting a succeeding ignition thyristor, which discharges an ignition capacitor, also charged separately by the piezo element, into an electric ignition means.

However, this solution entails the disadvantage of the dependence of the self-destruct time $t_S$ on $U_o$ and $U_S$. Since piezo elements are subject to fabrication fluctuations and are temperature dependent, the voltage $U_o$ can fluctuate from shot to shot and therewith also the self-destruct times. In addition, a stable switching threshold $U_S$ with variable operating voltage, again requires circuitry expenditures, which lead to higher complexity and current consumption.

Therefore, a circuit is to be provided which, on the one hand, is of maximum simplicity and therefore as much as possible energy-saving, cost-efficient and at the same time (due to reduced number of structural parts) is reliable and which, on the other hand, permits realization the time function with RC networks independently of a fluctuating supply voltage level.

DETAILED DESCRIPTION OF THE INVENTION

Figure 1:
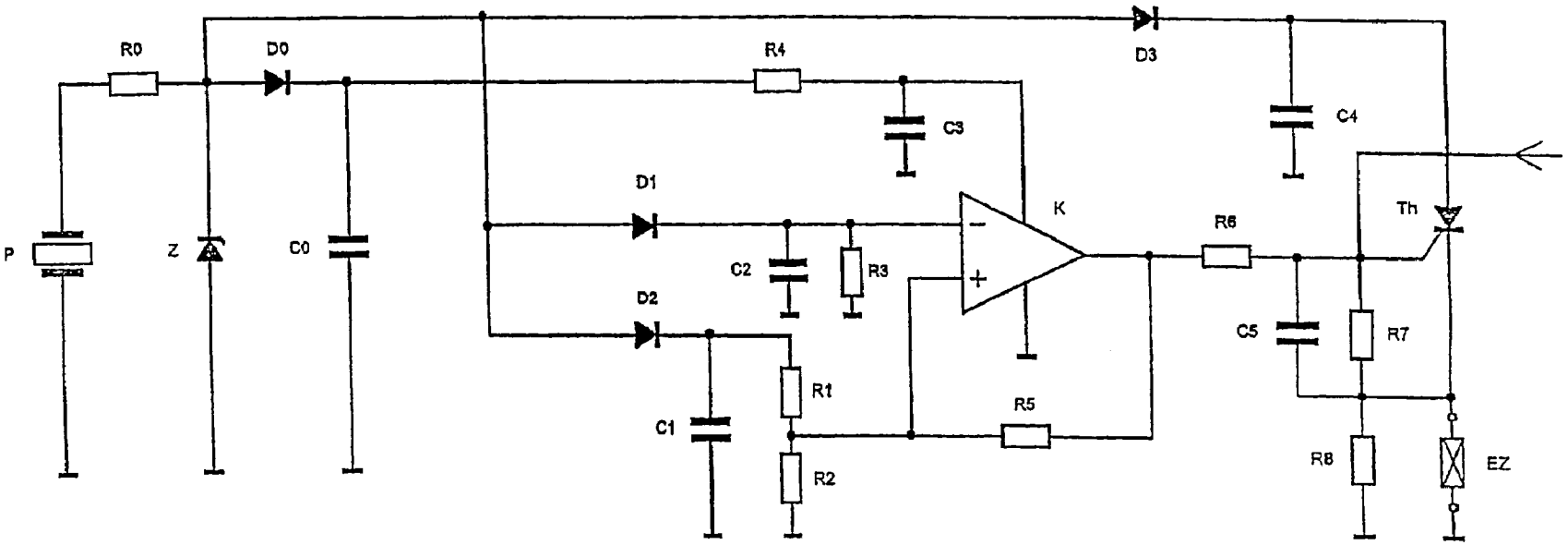
FIG. 1 illustrates an embodiment of the present invention.

In FIG. 1, capacitors C0 to C4 are charged during the firing via a piezo element P a voltage generator, a dropping resistor R0, a Zener diode Z (for voltage limitation) and diodes D0 to D3. Delayed across resistor R4 and the second storage capacitor C3, the charged capacitor C0 subsequently provides the supply voltage for the operation of a comparator K. The comparator K is a commercially available integrated [circuit] package with extremely low current consumption (<1 $\mu$A), very low input currents (<pA) and a common mode range extending up to the limits of the operating voltage.

The delayed provision of the operating voltage is to prevent a malfunction during the barrel passage phase and the capacitor C3 charged with delay supplies at the point in time of the ignition the energy for driving the thyristor Th. The ignition capacitor C4 is charged across diode D3, and remains at a sufficient voltage level until the ignition of the thyristor Th. For realizing a time function independent of the voltage output by the piezo element P, according to the invention, the two capacitors C1 and C2 are charged, via the two high-blocking diodes D1 and D2, by the piezo element P to the same voltage $U_o$.

Capacitor C1 is connected to the positive input of comparator K across a voltage divider R1 and R2. Capacitor C2 is connected directly to the negative input of the comparator K and is discharged across resistor R3 after the firing.

For the rapid and reliable switching over, the comparator K is connected through positive feedback across resistor R5 and thus has hysteresis. After the firing, due to the voltage divider R1 and R2 at the minus input of comparator K, a higher positive voltage is present than at the plus input. The output of the comparator K is therefore at this point in time at zero potential. Capacitor C1 is subsequently discharged across the equivalent resistance $R_e$=R1+R2* with R2*=R||R5=R2 R5/(R2+R5).

Time constants $T_{1=Re}$ C1 and $T_2$=R3 C2 are selected such that $T_1>T_2$, i.e., C2 is discharged faster than C1. At the point in time of the self-destruct time set $$t_S=T_1T_2/(T_2-T_1)\ln(R2^*/R_e) \quad (2)$$

the potential at C2 (at the minus input of comparator K) falls below the more slowly changing potential of C1, reduced by the factor $R2^*/R_e$, at the plus input of comparator K. The comparator K subsequently switches its output voltage to positive potential and therewith ignites the ignition thyristor Th across the current limitation resistor R6 and the voltage divider R7 and R8. Capacitor C5 serves for disturbance suppression and is of no significance for the function principle.

The energy stored in ignition capacitor C4 is thereby switched through to electric ignition means EZ and the latter is made to trigger. Across the depicted input T, thyristor Th can also be ignited via the main ignition criteria by circuit parts not shown here.

A further simplification of the circuit and the calculation is obtained if the capacitors C1 and C2 are of equal value: C1=C2=C. The self-destruct time tS is then $$t_s=R_eC/(1-R_e/R3)\ln(R2^*/R_e) \quad (3)$$

which means that it can be adjusted nearly linearly within wide ranges by solely changing the resistance R3.

Through the difference formation of the present comparator circuitry no parameter variable is included in either equation (2) nor equation (3) during firing. The goal of the task consequently has been attained.

A changed field of application of the circuit is opened up if the charging of the capacitors C0 to C4 is carried out by a piezo element during the firing through a voltage in a warhead, which is either permanently applied or is generated shortly before the ejection of submunition under control by a warhead is electronic circuitry. The circuit in this case serves for the time-controlled triggering of a self-destruction of the ejected submunition. As long as board voltage is applied, neither C1 nor C2 is discharged and nothing occurs at the comparator output. Only when the voltage supply is cut off (ejection of the submunition) is the self-destruct configuration activated; the capacitors C1 and C2 start discharging and, as described, initiate the ignition process.

Instead of the piezo element employed in connection with the embodiment example, a surge generator can also be utilized. In this case, in FIG. 1, the piezo element P would need to be replaced by a surge generator not depicted.

What is claimed is:

1. An apparatus for time-controlled self-destruction of a projectile, said apparatus comprising:

a voltage generator operable to generate a voltage during firing of the projectile;

a plurality of capacitors operable to be charged by the voltage generated by said voltage generator;

a voltage divider including a first resistor and a second resistor;

a comparator having a first input and a second input, wherein at least a first capacitor of said plurality of capacitors is connected via said voltage divider to said first input and at least a second capacitor of said plurality of capacitors is connected to said second input, and said first and second capacitors are adapted to be charged equally by the voltage generated by said voltage generator; and a third resistor connected in parallel with said second capacitor, wherein a resistance of said third resistor is higher than a sum of a resistance of said first resistor and a resistance of said second resistor.

2. An apparatus as recited in claim 1, wherein said first input of said comparator is a positive input and said second input of said comparator is a negative input.

3. An apparatus as recited in claim 1, further comprising a fourth resistor connected between said first input of said comparator and an output of said comparator, wherein said fourth resistor forms a feedback loop for said comparator.

4. An apparatus as recited in claim 1, wherein said voltage generator is one of a surge generator and a piezo element.

5. An apparatus as recited in claim 1, wherein said first and second capacitors have equal capacitances.

* * * * *